United States Patent [19]

Spinner

[11] Patent Number: 4,879,534

[45] Date of Patent: Nov. 7, 1989

[54] CONNECTING ELEMENT FOR WAVEGUIDES

[76] Inventor: Georg Spinner, Am Eichberg 12, 8152 Feldkirchen-Westerham, Fed. Rep. of Germany

[21] Appl. No.: 231,189

[22] Filed: Aug. 11, 1988

[30] Foreign Application Priority Data

Aug. 14, 1987 [DE] Fed. Rep. of Germany ..... 3727198

[51] Int. Cl.[4] ..... H01P 5/00

[52] U.S. Cl. ..... 333/257; 333/254

[58] Field of Search ..... 333/254, 256, 257

[56] References Cited

U.S. PATENT DOCUMENTS 2,479,220 8/1949 Early ..... 333/256
2,597,143 5/1952 Aron ..... 333/257
2,837,723 6/1958 Krantz et al. ..... 333/256
4,701,731 10/1987 Hanson et al. ..... 333/257

*Primary Examiner*—Paul Gensler
*Attorney, Agent, or Firm*—Henry M. Feiereisen

[57] ABSTRACT

A connecting element for waveguides includes two waveguide sections which are contacted with each other via a bent choke of two sections and mechanically connected so as to allow a longitudinal displacement, tilting and rotation relative to each other. One waveguide section is provided at its circumference with an axial annular groove extending radially outside the axial section of the choke and the second waveguide section is provided with a circumferential collar projecting at least in an axial direction and engaging in the annular groove.

8 Claims, 1 Drawing Sheet

CONNECTING ELEMENT FOR WAVEGUIDES

BACKGROUND OF THE INVENTION

The present invention refers to a connecting element for waveguides, and in particular to a connecting element for waveguides with their connection planes being spaced by a tolerance gap and/or with longitudinal axes tilted and/or rotated by a tolerance angle relative to each other.

In particular longer waveguide trains between fixedly installed assemblies (e.g. transmitter and transmitter/antenna switch bay) frequently have the problem that a tolerance gap exists between the last flanges to be connected and/or the longitudinal axes thereof are not precisely aligned and/or rotated relative to each other by a small angle. In order to attain a compensation of length and/or to overcome such misalignment, a flexible waveguide section is installed which may be upset or stretched to a certain degree. In addition, for compensating a flange rotation, a twistable waveguide section is installed which is longitudinally slotted and thus twistable by a small angle. The rf-tightness is, however, not sufficient in such a twistable waveguide section.

SUMMARY OF THE INVENTION

It is thus an object of the present invention to provide an improved connecting element for waveguides obviating the afore-stated drawbacks.

This object and others which will become apparent hereinafter are attained in accordance with the present invention by providing two waveguide sections which are contacted and mechanically coupled via a choke to allow the waveguide sections to be displaced in an axial direction, to be tilted and to be rotated relative to each other.

By utilizing a choke joint between the waveguide sections, it is possible to attain a compensation of the tolerance in length of up to about a few millimeters, simultaneously a twisting of the flanges of up to about ±10% and an axial misalignment of up to a few degrees. It has been surprisingly found that the choke joint which was used so far for threadably connected or also soldered waveguide flanges, as for example described in the German Pat. No. DE-PS 31 33 362, is essentially indifferent to variations of the gap between the waveguide sections when it comes to the reflection factor or the attenuation.

An rf-tight connection between the waveguide sections can be obtained in various ways. According to a preferred embodiment of the invention, one waveguide section is provided at its circumference with an axial annular groove extending radially outside the axial section of the choke, and the second waveguide section is provided with a circumferential collar projecting at least in an axial direction and engaging in the annular groove. Through such a connection, the waveguide sections mechanically guide each other.

In order to limit the axial tilting of the waveguide sections relative to each other, the radial thickness of the collar is preferably dimensioned smaller than the radial width of the annular groove.

According to a further feature of the invention, the one waveguide section including the annular groove extends over the other waveguide section beyond its collar and ends in a guide and safety ring in order to limit the axial displacement and to further improve the rf-tightness. Suitably, the connection is sealed mechanically against the environment by inserting an O-ring in the gap between the overlapping part of the one waveguide section and the overlapped part of the other waveguide section. By making the O-ring of a rf-conducting rubber mixture, an almost complete rf-tightness is attained.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
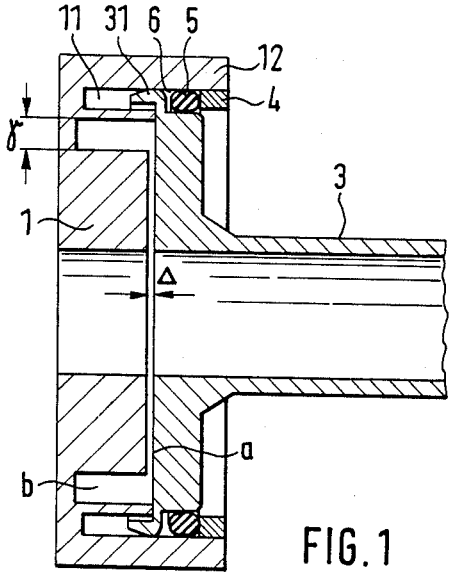
FIG. 1 is a schematically simplified longitudinal section of a first embodiment of a rectangular waveguide connection in accordance with the present invention taken along the broad side thereof.
Figure 2:
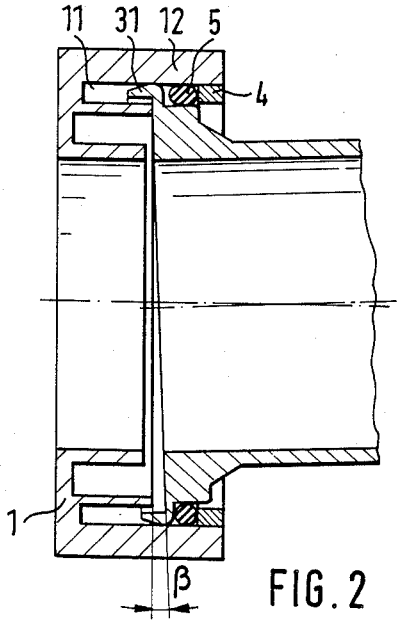
FIG. 2 is a longitudinal section of the rectangular waveguide connection of FIG. 1 taken along the narrow side thereof.
Figure 3:
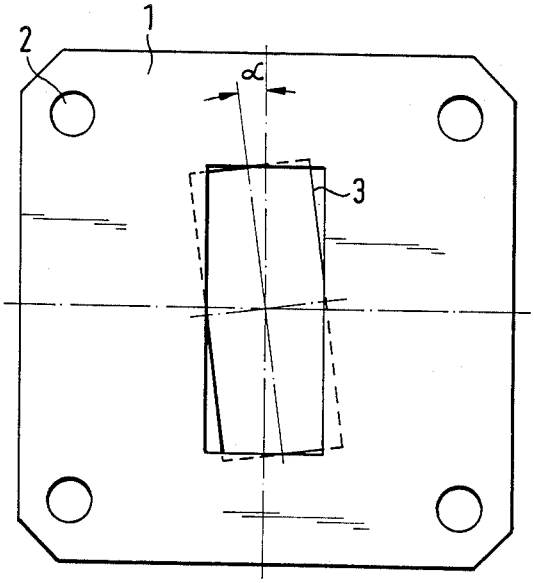
FIG. 3 is a top view of one front end of the rectangular waveguide connection according to FIG. 1.

Referring now to the drawing, and in particular to FIGS. 1 to 3 there is shown a first embodiment of a connecting element for waveguides in accordance with the invention, in particular a rectangular waveguide connection which includes a first waveguide section 1 with flanged connection bores 2 (FIG. 3) and a second waveguide section 3 in axial alignment with the waveguide section 1. The contact making connection between the waveguide sections 1, 3 is attained through a choke joint i.e. a $\lambda/2$ channel or a $\lambda/2$ stub and defined by a section a of variable width $\Delta$ which corresponds to the gap between the waveguide sections 1 and 3, and an axial section b with a width $\gamma$. Both sections a, b have a length of $\lambda/4$.

The waveguide section 3 is displaceable in longitudinal direction and—as shown in FIG. 2—tiltable relative to the waveguide section 1 by an angle $\beta$. This is attained by providing the waveguide section 3 with an axially projecting circumferential collar 31 which extends radially outside of the axial stub b and engages in an axial annular groove 11 of the waveguide section 1. The collar 31 has a radial thickness which is adjusted to the width of the annular groove 11 in such a manner that a jamming of the waveguide sections 1, 3 is prevented when waveguide section 3 is tilted as indicated in FIG. 2. Preferably, the radial thickness of the collar 31 is smaller than the radial width of the annular groove 11, and the axial length of the collar 31 exceeds the maximum range of displacement between the waveguide sections 1, 3.

In addition to the longitudinal displacement and the tilting ability, the waveguide section 3 is also rotatable relative to the waveguide section 1 by an angle $\alpha$ as shown in FIG. 3. The angle $\alpha$ can be of a magnitude of $\pm$ 10°, and its maximum value is defined by the admissible reflection factor under consideration of the longitudinal displacement and/or tilting of the waveguide sections 1, 3 attributing to the reflection factor.

To ensure the rf-tightness and for limiting the displacement in longitudinal direction, the waveguide section 1 is provided with an external ring portion 12 which extends beyond the radial width of the waveguide section 3 and overlaps the collar 31. Inserted in the ring section 12 is a guide and safety ring 4 which provides a stop surface for an O-ring 5 made of rf-conducting rubber. The O-ring 5 is incorporated in an annular recess 6 between the waveguide section 3 and the ring portion 12 of the waveguide section 1. As shown e.g. in FIG. 2, at its side facing the ring portion 12, the collar 31 is preferably provided with an inclined outer surface and with a rounded edge bearing against the inside of the ring portion 12 so as to allow the waveguide section 3 to be suitably tilted relative to the waveguide section 1.

Figure 4:
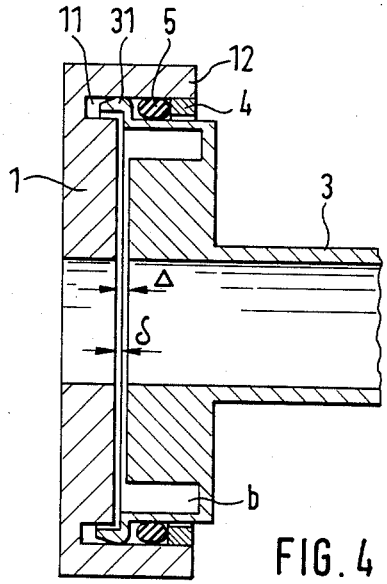
FIG. 4 is a longitudinal section of a second embodiment of a rectangular waveguide connection in accordance with the present invention taken along the broad side thereof.

Turning now to FIG. 4, there is shown a second embodiment of a rectangular waveguide connection in accordance with the invention, the only difference to the first embodiment residing in the fact that section b of the bent choke joint is provided in the waveguide section 3 instead of the waveguide section 1 as shown in FIGS. 1 to 3. Otherwise the embodiment of FIG. 4 corresponds to the embodiment of FIG. 1 so that same reference numerals have been used for identical parts. In the position of FIG. 4, the waveguide section 3 is shown as being displaced relative to the waveguide section 1 by the amount $\delta$.

While the invention has been illustrated and described as embodied in a Connecting Element for Waveguides, it is not intended to be limited to the details shown since various modifications and structural changes may be made without departing in any way from the spirit of the present invention.

What is claimed as new and desired to be protected by Letters Patent is set forth in the appended claims:

I claim:

1. A connecting element for waveguides, comprising:

a first waveguide section;

a second waveguide section; and choke means for electrically coupling said first and second waveguides, said first and second waveguide sections being mechanically connectable via said choke means for permitting said waveguide sections to be displaced in an axial direction, to be tilted and to be rotated relative to each other, said choke means including a first section extending between facing connecting planes of said first and second waveguide sections and an axial section provided in one of said waveguide sections, said first waveguide section being provided at its periphery with an axial annular groove extending radially outside said axial section of said choke means, and said second waveguide section being provided with a circumferential collar projecting at least in an axial direction and engaging in said annular groove.

2. A connecting element as defined in claim 1 wherein said collar has an axial length which exceeds the maximum admissible range of displacement between said waveguide sections.

3. A connecting element as defined in claim 1 wherein said collar has a radial thickness and said annular groove has a radial width, said radial thickness of said collar being smaller than the radial width of said annular groove.

4. A connecting element as defined in claim 1, and further comprising a guide and safety ring, said first waveguide section extending over said second waveguide section beyond said collar and ending in said guide and safety ring.

5. A connecting element as defined in claim 1 wherein said first waveguide section extends over said second waveguide section beyond said collar to define a recess therebetween, and further comprising an O-ring disposed in said recess.

6. A connecting element as defined in claim 5 wherein said O-ring is made of rf-conducting rubber.

7. A connecting element for waveguides, comprising:

a first waveguide section;

a second waveguide section; and a choke defined by a gap between facing connecting planes of said first and second waveguide section for electrically coupling the latter, said first and second waveguide sections being mechanically connectable in such a manner that under variation of said gap said waveguide sections are axially displaceable, tiltable and rotatable relative to each other, said first waveguide section being provided at its periphery with an axial annular groove extending radially outside said choke, and said second waveguide section being provided with a circumferential collar projecting at least in an axial direction and engaging in said annular groove.

8. A connecting element as defined in claim 7, wherein said choke includes a first section extending between facing connecting planes of said first and second waveguide sections and an axial section provided in one of said waveguide sections, said axial groove extending radially outside said axial section of said choke.

* * * * *